US006662972B2

(12) United States Patent
Chu

(10) Patent No.: US 6,662,972 B2
(45) Date of Patent: Dec. 16, 2003

(54) CAP DEVICE FOR OBTAINING A CERTAIN AMOUNT OF STUFF IN CONTAINERS

(76) Inventor: Lien-Fang Chu, 5F-2, No. 3, Lane 103, Sec. 3, MinChuan E. Road, Taipei (TW)

( * ) Notice: Subject to any disclaimer, the term of this patent is extended or adjusted under 35 U.S.C. 154(b) by 85 days.

(21) Appl. No.: 10/115,764

(22) Filed: Apr. 2, 2002

(65) Prior Publication Data

US 2003/0183660 A1 Oct. 2, 2003

(51) Int. Cl.[7] ..... B67D 5/38
(52) U.S. Cl. ..... 222/158; 222/440; 222/452
(58) Field of Search ..... 222/158, 438, 222/440, 444, 451, 452

(56) References Cited

U.S. PATENT DOCUMENTS 1,671,542 A * 5/1928 Perks ..... 222/440
1,840,190 A * 1/1932 Dyck ..... 222/158
4,690,313 A * 9/1987 Luine et al. ..... 222/454
4,961,521 A * 10/1990 Eckman ..... 222/142.5
5,588,563 A * 12/1996 Liu ..... 222/158
5,944,230 A * 8/1999 Chiang ..... 222/158
6,378,735 B1 * 4/2002 Chu ..... 222/158

* cited by examiner

*Primary Examiner*—Joseph A. Kaufman

(57) ABSTRACT

A cap device mounted to an opening of a container includes a base with its skirt 12 securely engaged with the opening of the container and a hole is defined through the base and a neck extends from the base and encloses the hole. An access portion is rotatably engaged with the neck and includes a tube extending therefrom at an angle. A slidable tube is slidably mounted to the tube so that the stuff in the container can be poured into the slidable tube without opening the cap device. A fastening belt is securely mounted to the skirt of the base.

2 Claims, 9 Drawing Sheets

CAP DEVICE FOR OBTAINING A CERTAIN AMOUNT OF STUFF IN CONTAINERS

FIELD OF THE INVENTION

The present invention relates to a cap device connected to a container and is able to obtain a certain amount of stuff in the container without removing the cap device.

BACKGROUND OF THE INVENTION

A conventional container generally includes a container and a cap which seals the opening of the container. The cap can be disengaged from the opening so that the stuff in the container can be poured out from the container via the opening. Nevertheless, for some stuff stored in the container such as milk powder or the like which is supposed to be stored in a dry place and avoided from being accessed by moisture, is not suitable to be stored in the containers as described above. The conventional container is used by remove the cap from the opening and get the stuff by letting the stuff stored in the container being poured through the opening. During the pouring process, the opening is opened to the air. Besides, the conventional cap device does not provide a feature that allows the user to get a certain amount of the stuff from the container. The user may have to pour some more stuff from the container, or put some stuff back into the container to obtain a certain amount of the stuff precisely. This prolongs the period of time of keeping the opening being opened.

SUMMARY OF THE INVENTION

The present invention relates to a cap device mounted to an opening of a container and comprises a base securely engaged with the opening of the container by a fastening belt mounted on a skirt of the base. A hole is defined through the base and a neck extends from the base and encloses the hole. An access portion is rotatably engaged with the neck and includes a tube extending therefrom at an angle. The access portion communicates with the hole and a slidable tube is slidably mounted to the tube. The fastening belt includes a first end and a second end which is connected to the first end of the fastening belt.

The primary object of the present invention is to provide a cap device that is securely mounted to a container and a tube extends from the device at an angle. A slidable tube is movably mounted to the tube so that the stuff in the container can be collected in the slidable tube at a certain amount without removing the base from the container.

The present invention will become more obvious from the following description when taken in connection with the accompanying drawings which show, for purposes of illustration only, a preferred embodiment in accordance with the present invention.

DETAILED DESCRIPTION OF THE INVENTION

Figure 1:
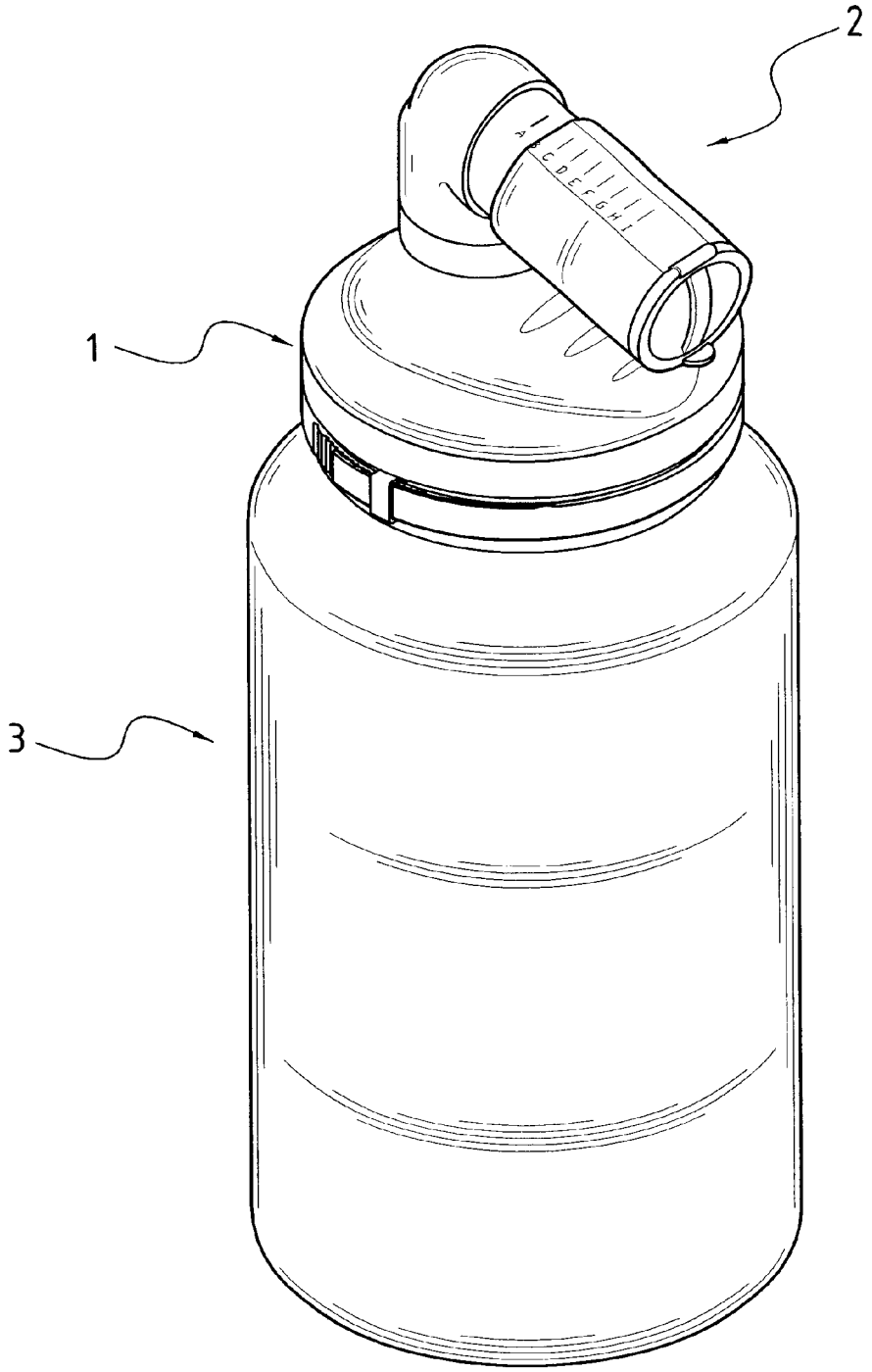
FIG. 1 is a perspective view to show a container with the cap device of the present invention.
Figure 2:
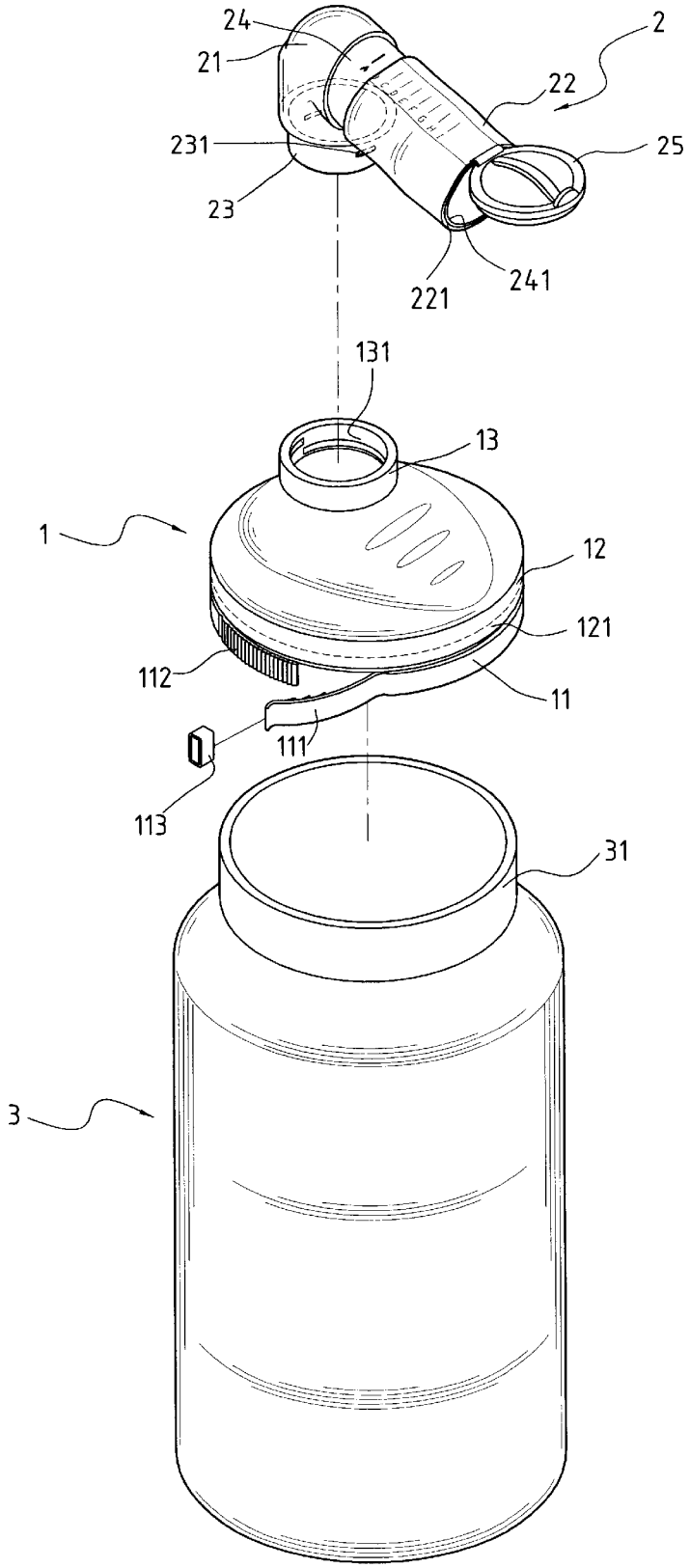
FIG. 2 is an exploded view to show the cap device and the container.
Figure 3A:
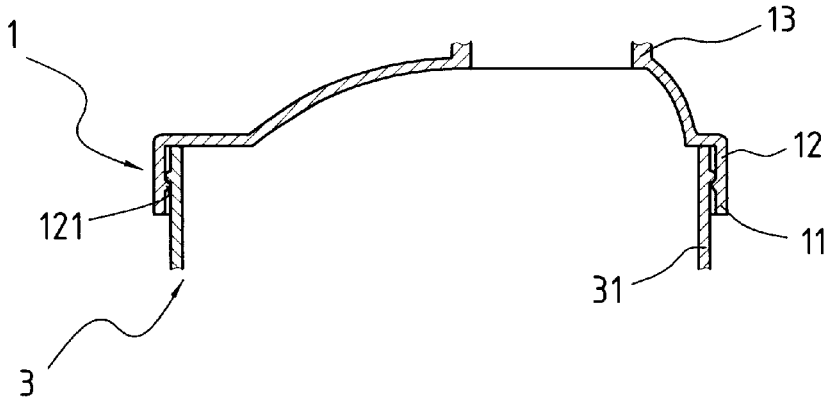
FIG. 3A is a cross sectional view to show the base mounted to the container.
Figure 3B:
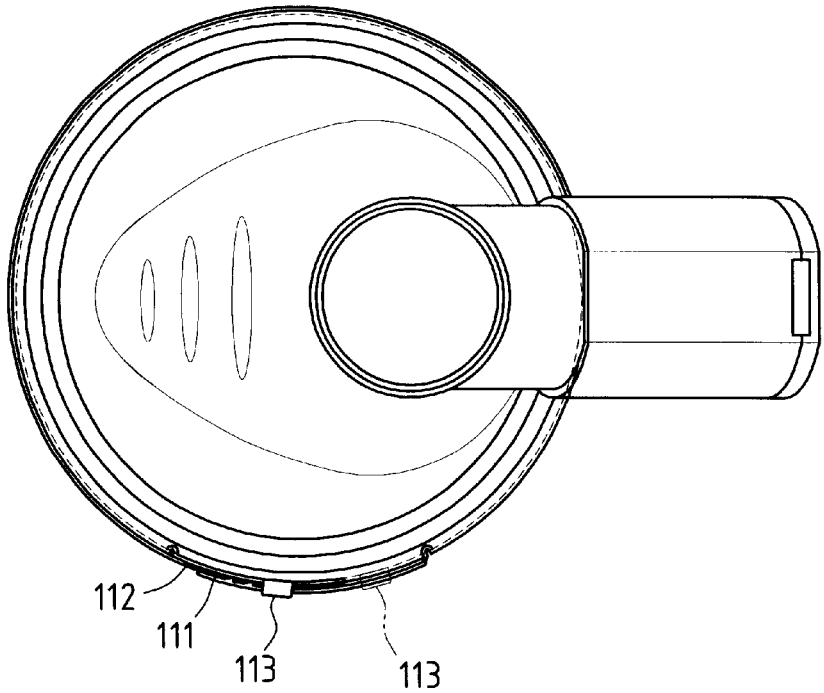
FIG. 3B shows the cap device is secured to the container by a fastening belt.

Referring to FIGS. 1, 2, 3A, 3B and 8, the cap device of the present invention comprises a base 1 having a skirt 12 which has at least one annular ridge 121 extending from an inside of the skirt 12 so as to mount on a neck 31 of the container 3. The neck 31 encloses an opening of the container 3. A fastening belt 11 is mounted to an outside of the skirt 12 of the base 1 and includes a first end 111 and a second end 112 which is connected to the first end 111 of the fastening belt 11. Each of the first end 111 and the second end 112 of the fastening belt 11 has teeth which are engaged with each other. A retaining ring 113 is mounted to the overlapped portion of the first end 111 and the second end 112 so as to position the overlapped portion of the fastening belt 11. A hole is defined through the base 1 and is enclosed by a neck 13 extending from the base 1. A plurality sections of grooves 131 are defined in an inside of the neck 13.

An access portion 2 is rotatably engaged with the neck 13 and includes an insertion 23 rotatably engaged with the neck 13. A plurality of ribs 231 extend from the insertion 23 and are slidably received in the grooves 131. A connection member 21 is connected to the insertion 23 and a tube 24 extends from the connection member 21 at an angle to maintain a distal end of the tube 24 to orient downward. The connection member 21 communicates with the hole in the base 1. A slidable tube 22 is slidably mounted to the tube 24 and an aperture 221 defined in a distal end the slidable tube 22 and a cap 25 is pivotally connected to the slidable tube 22 and seals the aperture 221 of the slidable tube 22. The tube 24 communicates with the connection member 21.

Figure 4A:
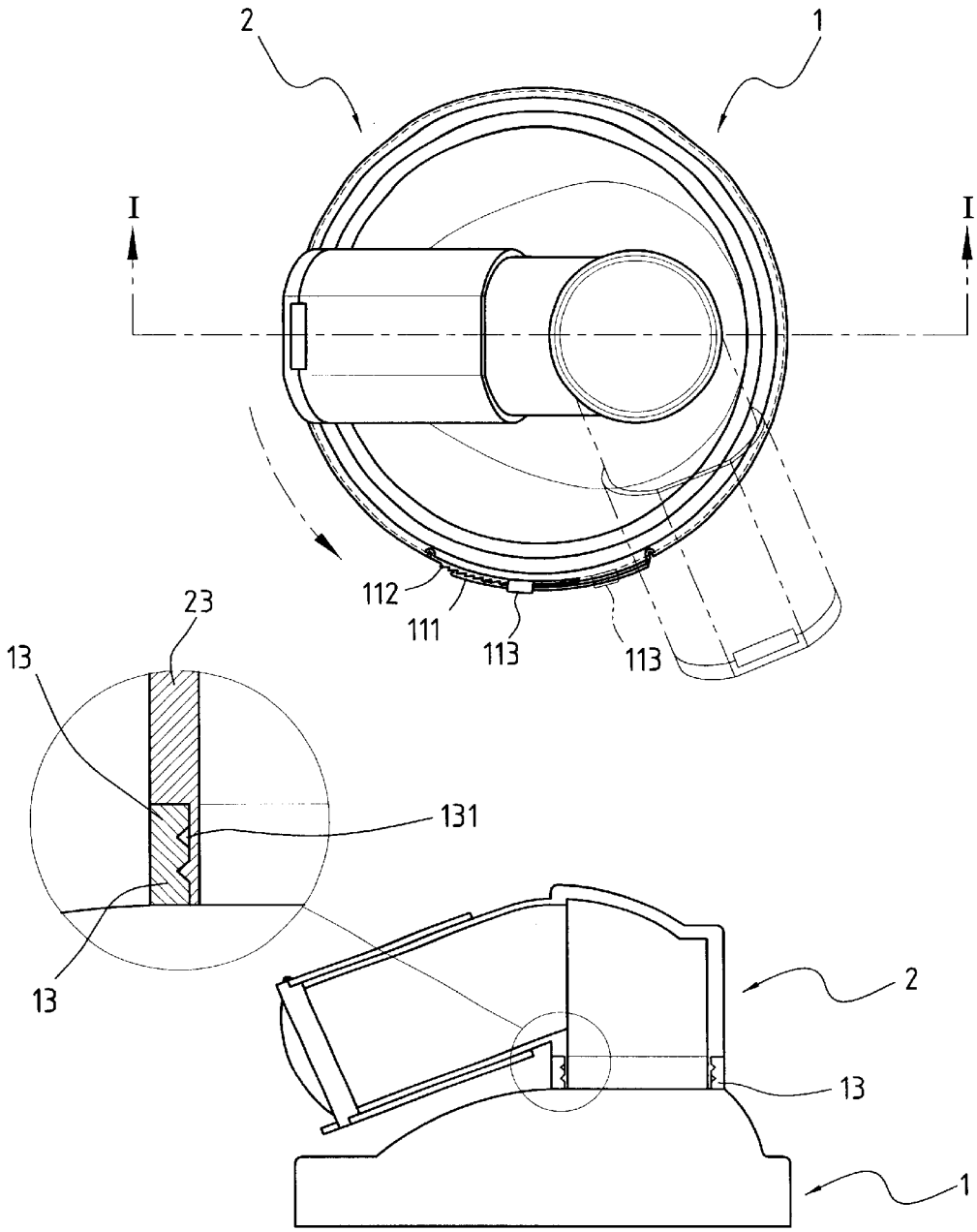
FIG. 4A shows the cap device is rotatable on the container.
Figure 4B:
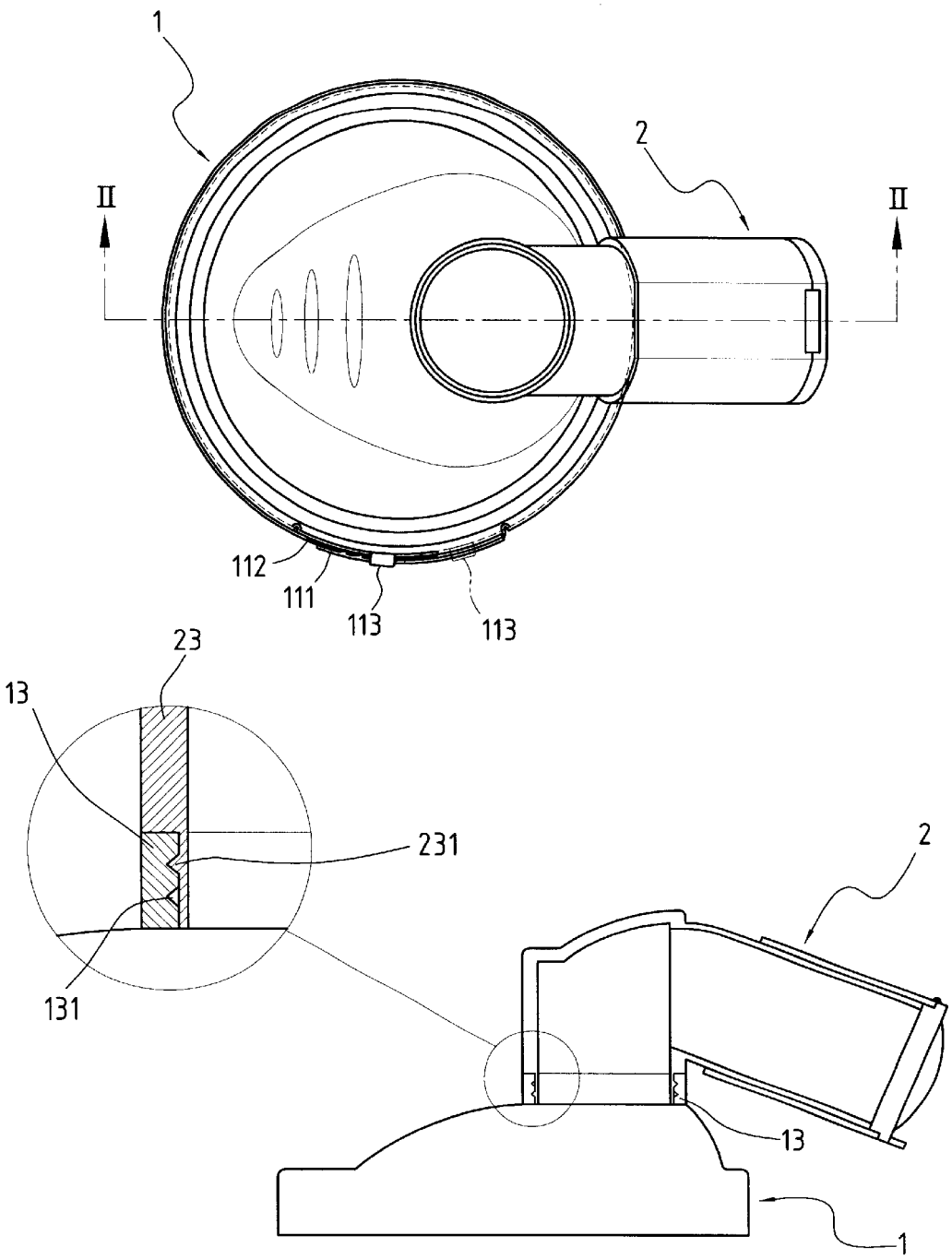
FIG. 4B shows the tube of the cap device is rotated on the container.
Figure 5A:
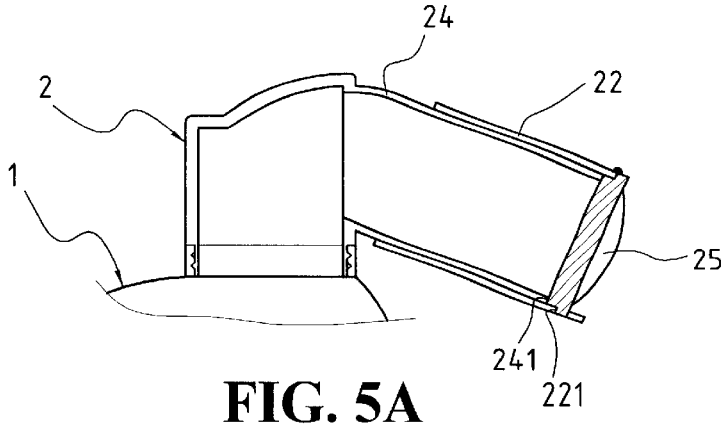
FIGS. 5A–5C show the slidable tube is slid on the tube and the cap on the slidable tube can be opened.
Figure 5B:
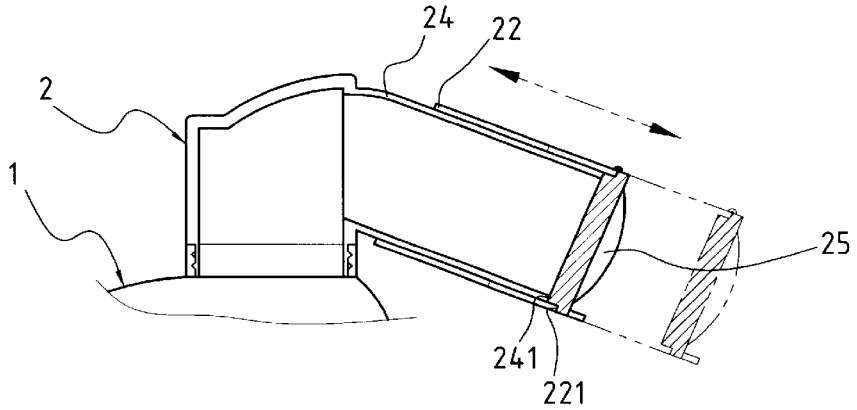
Figure 5C:
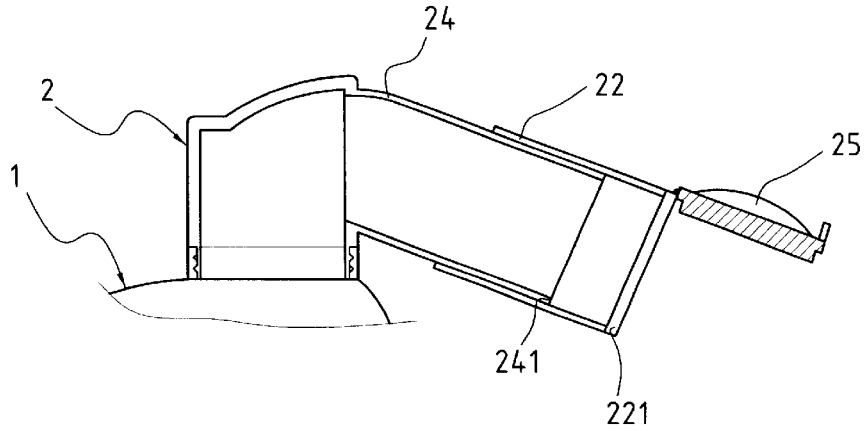

Referring to FIGS. 4A and 4B, the access portion 2 can be rotated relative to the neck 13 on the base 1 till the ribs 231 is stopped by an end of the respective grooves 131. As shown in FIGS. 5A to 5C, the slidable tube 22 is then slid away from the connection member 21 and the stuff in the container 3 is then poured into the slidable tube 22 via the hole in the base 1. There are scale marks on the tube 24 and the slidable tube 22 so that the volume of the stuff can be controlled in the slidable tube 22 by the marks. When the container is put upright, the stuff in the downward slidable tube 22 will not the go back into the container 3 so that a certain amount of the stuff is collected. The stuff in the slidable tube 22 can be poured out by opening the cap 25.

Figure 6A:
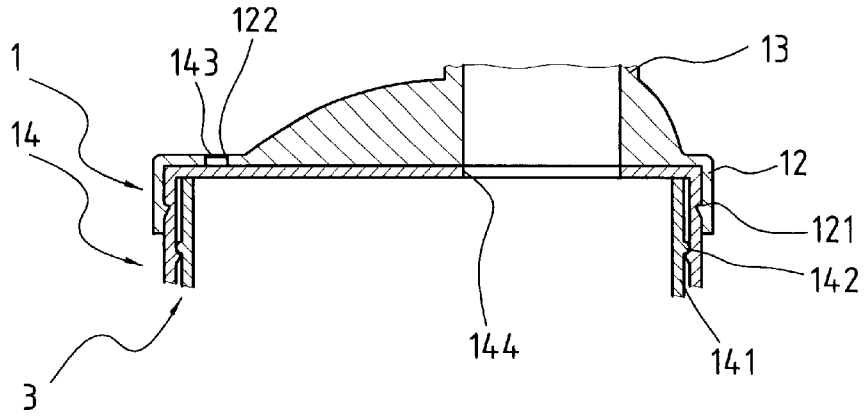
FIG. 6A is a cross sectional view to show an intermediate cover is installed between the base and the container.
Figure 6B:
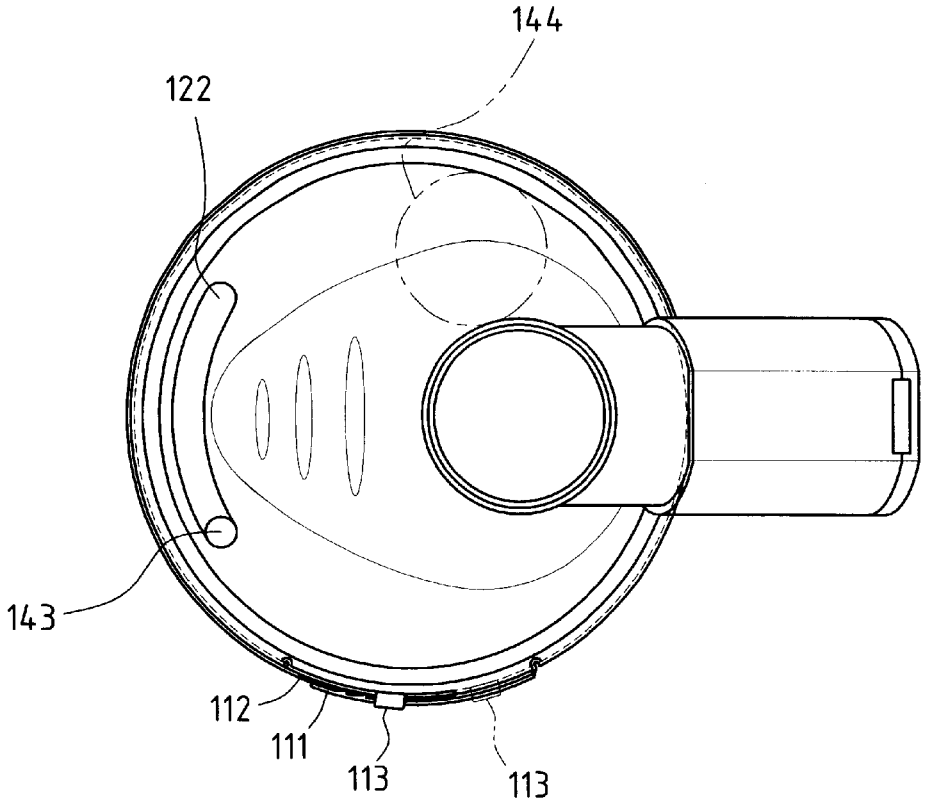
FIG. 6B shows a top view of the cap device with the an intermediate cover.
Figure 7:
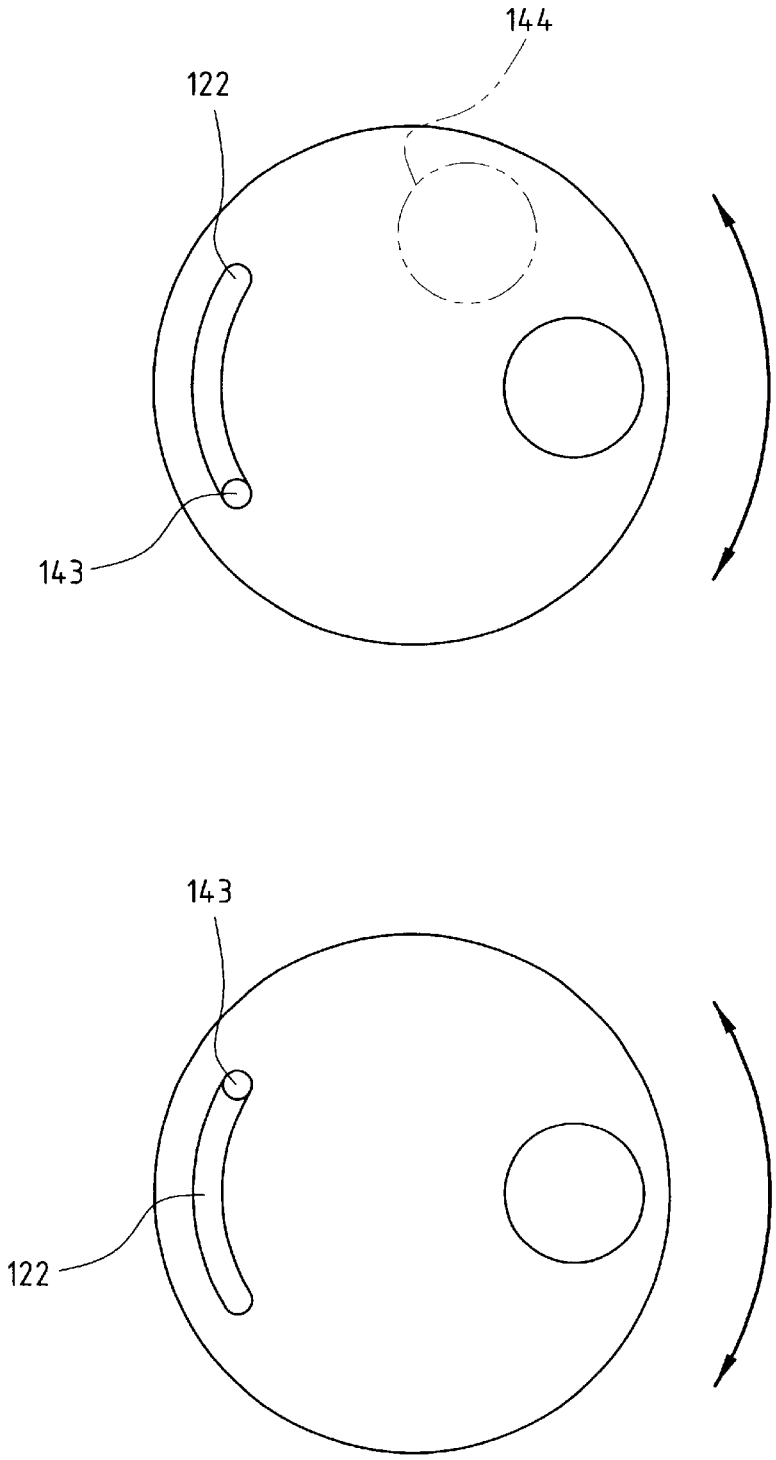
FIG. 7 shows the intermediate cover is rotated and the position of the outlet is shifted.
Figure 8:
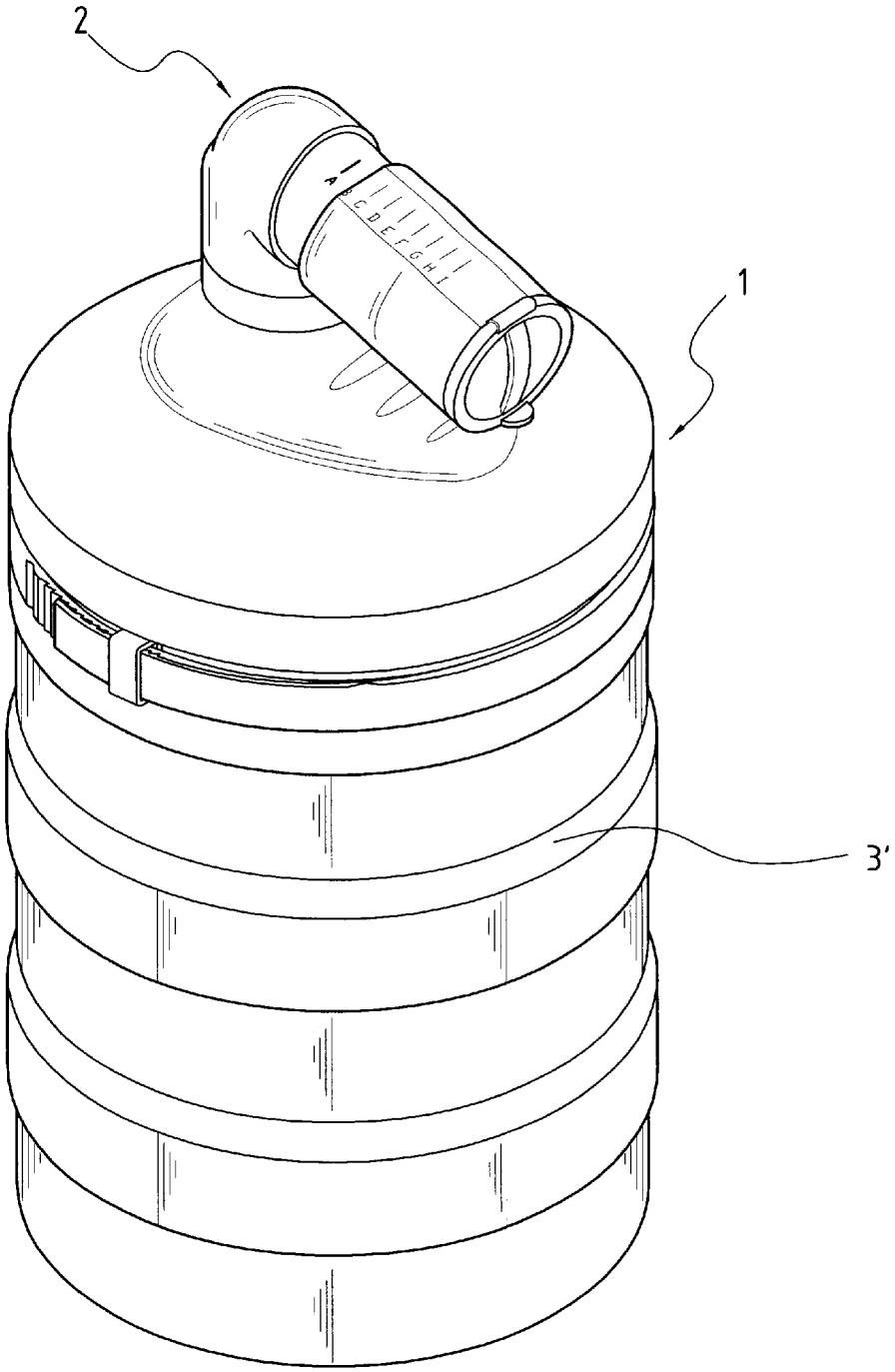
FIG. 8 shows the cap device is connected to a milk container.

Referring to FIGS. 6A, 6B and 7, an intermediate cover 14 can be mounted to the opening of the container 3 and is sandwiched between the base 1 and the neck 31 of the container 3. An outlet 144 is defined through the intermediate cover 14 and the base 1 is securely and rotatably mounted to the intermediate cover 14. A protrusion 143 extends from a top of the intermediate cover 14 and a slot 122 defined through the base 1. The protrusion 143 is engaged within the slot 122 so as to limit the range of the rotation of the base relative to the intermediate cover 14. The stuff in the container 3 can only be poured into the slidable tube 22 by rotating the base 1 relative to the intermediate cover 14 till the outlet 144 is located in alignment with the connection member 21.

While we have shown and described the embodiment in accordance with the present invention, it should be clear to those skilled in the art that further embodiments may be made without departing from the scope of the present invention.

What is claimed is:

1. A cap device mounted to an opening of a container, comprising:

a base having a skirt which is adapted to be securely engaged with the opening of the container, a hole defined through the base and a neck extending from the base and enclosing the hole;

an access portion rotatably engaged with the neck and including a tube extending therefrom at an angle, a slidable tube slidably mounted to the tube and the tube adapted to communicate with the opening of the container, and an aperture defined in a distal end the slidable tube and a cap pivotally connected to the slidable tube and sealing the aperture of the slidable tube.

2. The device as claimed in claim 1, further comprising a plurality sections of grooves defined in an inside of the neck and the connection member has an insertion rotatably engaged with the neck, a plurality of ribs extending from the insertion and slidably received in the grooves.

* * * * *